United States Patent [19]

Imai

[11] Patent Number: 4,589,182

[45] **Date of Patent: * May 20, 1986**

[54] METHOD AND APPARATUS FOR FORMING A SPACE SECTION IN A PAIR OF CONTINUOUS CONCEALED-SLIDE-FASTENER STRINGERS

[75] Inventor: Shigeru Imai, Namerikawa, Japan

[73] Assignee: Yoshida Kogyo K. K., Tokyo, Japan

[ * ] Notice: The portion of the term of this patent subsequent to Apr. 16, 2002 has been disclaimed.

[21] Appl. No.: 673,732

[22] Filed: Nov. 21, 1984

[30] Foreign Application Priority Data

Nov. 25, 1983 [JP] Japan ..... 58-221599

[51] Int. Cl.[4] ..... B21D 53/54; A41H 37/06

[52] U.S. Cl. ..... 29/410; 29/33.2; 29/770

[58] Field of Search ..... 29/33.2, 408–410, 29/766–770

[56] References Cited

U.S. PATENT DOCUMENTS 3,490,133 1/1970 Glindmeyer et al. ..... 29/770
3,812,573 5/1974 Fukuori ..... 29/770
3,812,754 5/1974 Kawakami ..... 29/33.2
3,863,323 2/1975 Takamatsu ..... 29/770
3,958,319 5/1976 Takamatsu ..... 29/410
4,510,662 4/1985 Matsumoto et al. ..... 29/408

*Primary Examiner*—Howard N. Goldberg
*Assistant Examiner*—Steven Nichols
*Attorney, Agent, or Firm*—Hill, Van Santen, Steadman & Simpson

[57] ABSTRACT

In a method and apparatus for forming a space section in a pair of concealed-slide-fastener stringers, with a pair of tapes gripped with interengaged coupling elements disposed at the upper side of the tapes, a pair of continuous concealed-slide-fastener stringers is pushed upwardly from the under side of the tapes by a pair of laterally spaced and vertically movable dies until head portions of a series of the interengaged coupling elements are exposed to the dies and supported thereon. A punch is then lowered to cut upper legs of certain interengaged coupling elements supported on the raised dies. Finally, an ejector is raised through the dies to clamp the cut coupling elements against the punch and continues to be moved upwardly together with the punch to pull the cut coupling elements out of sewn stitches.

10 Claims, 8 Drawing Figures

METHOD AND APPARATUS FOR FORMING A SPACE SECTION IN A PAIR OF CONTINUOUS CONCEALED-SLIDE-FASTENER STRINGERS

BACKGROUND OF THE INVENTION

1. Field of the Invention

The present invention relates to the production of slide fasteners, and more particularly to a method of and an apparatus for forming an element-free space section in a pair of continuous concealed-slide-fastener stringers.

2. Prior Art

A number of devices for the purpose described above are known in which a chain of interengaged filamentary coupling elements attached by sewn stitches to a pair of continuous tapes along their folded inner longitudinal edges is cut for a length corresponding to the length of an element-free space section by means of a punch and a die. It has been a common practice to this end that the tapes are pulled apart locally in order to allow the punch to enter between the adjacent tape edges so that the cutting of the coupling elements is accomplished without cutting the tapes. However, pulling the tapes locally would often make the tapes to become unrecoverably deformed or otherwise damaged. Further, due to this tape pulling, an increased rate of production with the prior apparatus is difficult to achieve. Such prior art is exemplified by U.S. Pat. No. 3,225,430, issued Dec. 28, 1965, and French Pat. No. 1,561,401, issued Mar. 28, 1969.

A solution has been proposed by Japanese Utility Model Publication (Jikkosho) 51-4802, in which a guide member having a tapering forward end portion is employed to force the adjacent folded tape edge portions apart to expose head portions of a series of the interengaged coupling elements. A punch is moved toward a die through a rectangular opening in the guide member to cut the exposed head portions of the coupling elements supported on the die. However, since it is necessary to force the guide member against the coupling elements continually, high-speed feeding of the fastener stringers through the apparatus cannot be achieved, and the coupling elements can be easily damaged by the guide member. Further, in this prior apparatus, the head portions of the coupling elements are only cut with the leg portions remaining on the folded tape edges and, therefore, it is impossible to form a space section perfectly free from any coupling element piece.

SUMMARY OF THE INVENTION

In the method and apparatus according to the present invention, with a pair of tapes gripped with interengaged coupling elements disposed at the upper side of the tapes, a pair of continuous concealed-slide-fastener stringers is pushed upwardly from the under side of the tapes by a pair of laterally spaced and vertically movable dies until head portions of a series of the interengaged coupling elements are exposed to the dies and supported thereon. A punch is then lowered to cut certain interengaged coupling elements on the raised dies. Finally, an ejector is raised through the dies to clamp the cut coupling elements against the punch and continues moving upwardly together with the punch to pull the cut coupling elements out of sewn stitches.

It is therefore an object of the present invention to provide a method and an apparatus in which an element-free space section can be formed in a pair of continuous concealed-slide-fastener stringers accurately without deforming or otherwise damaging a pair of tapes.

Another object of the invention is to provide a method and an apparatus for forming a perfectly element-free space section in a pair of continuous concealed-slide-fastener stringers without any coupling element pieces remaining on the tape edges.

Still another object of the invention is to provide such an apparatus which can be operated at high speed without risk of impairing a pair of element-supporting folded tape edges, thereby enabling an improved rate of production of adequate quality concealed-slide-fasteners.

Many other advantages, features and additional objects of the present invention will become manifest to those versed in the art upon making reference to the detailed description and the accompanying drawings in which a preferred embodiment incorporating the principles of the present invention is shown by way of illustrative example.

DETAILED DESCRIPTION

Figure 1:
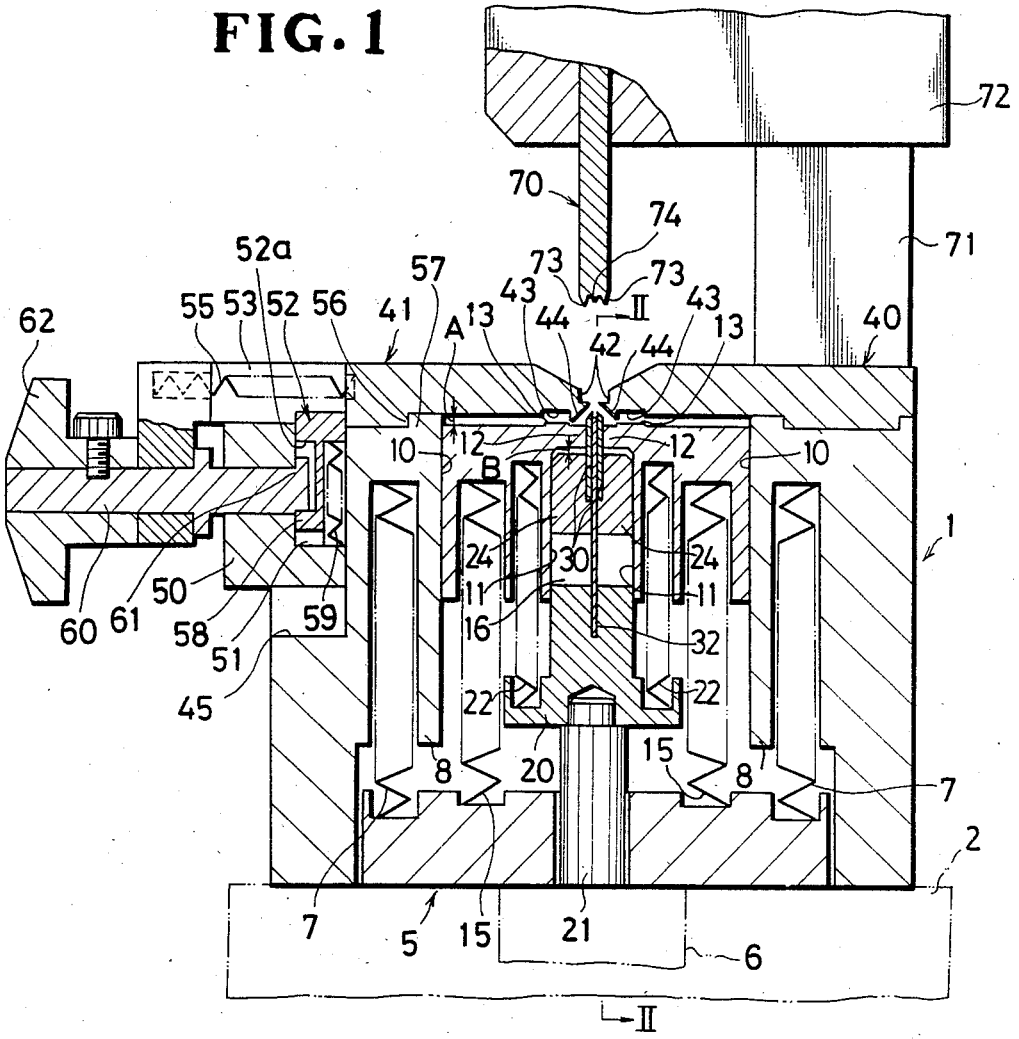
FIG. 1 is a vertical cross-sectional view of an apparatus embodying the present invention.
Figure 4:
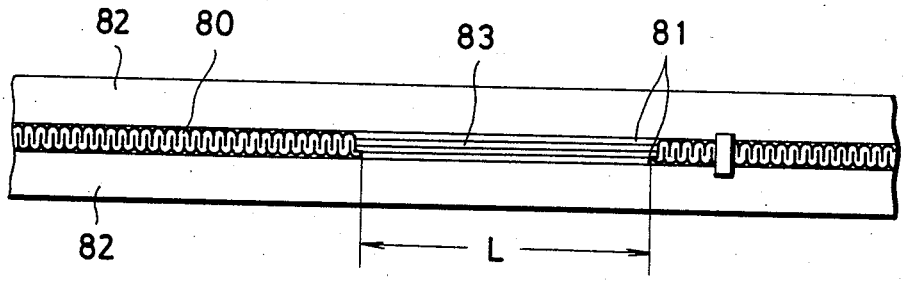
FIG. 4, appearing with FIG. 2, is a fragmentary plan view of a pair of continuous slide fastener stringers having an element-free space section formed by the apparatus.

FIG. 1 shows an apparatus for forming an element-free space section 83 (FIG. 4) in a pair of continuous fastener stringers for the production of concealed slide fasteners. The concealed-slide-fastener stringers (FIG. 4) include a pair of continuous tapes 82, 82 carrying along their folded inner longitudinal edges 81, 81 a pair of rows of interengaged continuous filamentary coupling elements 80 attached to the respective folded tape edges 81, 81 by sewn stitches 85, 85 (FIGS. 3A through 3E).

The apparatus generally comprises a support table 1 mounted on a stationary base 2, and a pair of spaced guide plates 40, 41 mounted on the support table 1 in confronting relation to each other. A pressure pad 12 and a pair of laterally spaced dies 30, 30 are disposed in a vertical bore 10 in the support table 1 and define with the guide plates 40, 41 a guide groove receptive of the fastener stringers with the interengaged coupling elements 80 disposed at the upper side of the tapes 82, 82.

The guide plates 40, 41 have along their confronting edges a pair of step portions 42, 42, respectively, for supporting the interengaged coupling elements 80 together with the folded tape edges 81, 81. The guide plates 40, 41 are disposed one on each side of the guide groove extending thereover toward and terminating short of each other. One guide plate 40 is fixed to the support table 1, while the other guide plate 41 is movable toward and away from the one guide plate 40 for a purpose described below.

The pressure pad 12 is upwardly movable toward the guide plates 40, 41 for gripping therewith portions of the tapes 82, 82 around a space-section length L (FIG. 4) of the interengaged coupling element rows 80. The pressure pad 12 has on its top surface a pair of parallel elongated lands 13, 13 disposed one at each side of the dies 30, 30, while the guide plates 40, 41 have in their under surfaces a pair of elongated recesses 43, 43 complementary to the lands 13, 13, respectively. Each guide plate 40, 41 also has an elongated jaw 44 disposed between the respective step portion 42 and the respective recess 43. The lands 13, the recesses 43 and the jaws 44 jointly serve to prevent the gripped tapes 82, 82 from being slipped or displaced on the gripping surfaces as shown in FIG. 3B.

Figure 3A:
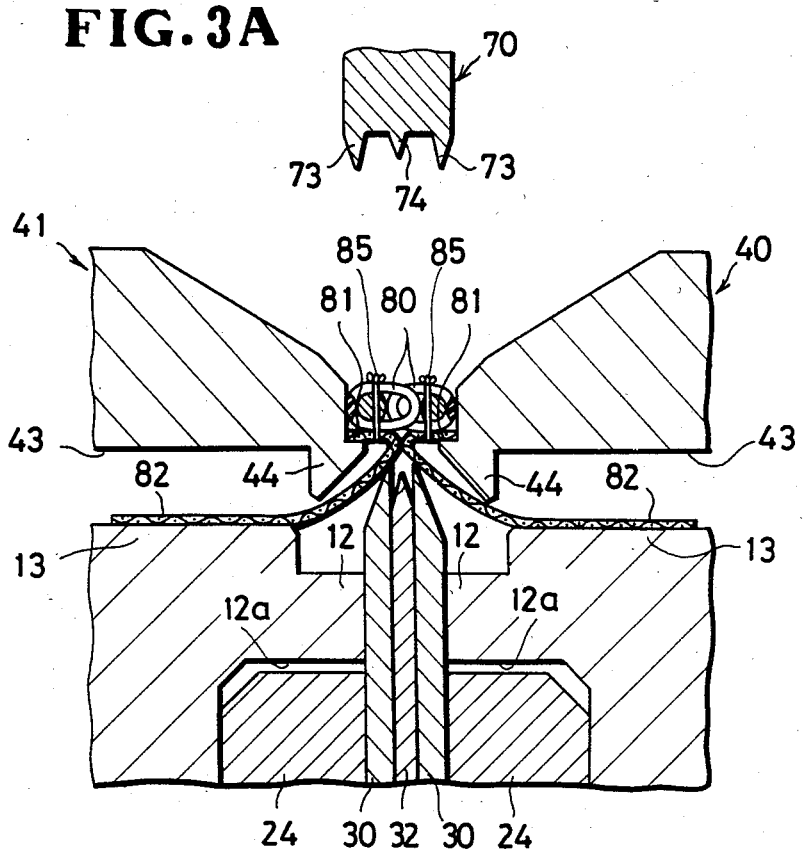
FIGS. 3A through 3E are cross-sectional detail views illustrating the manner in which an element-free space section is formed in a pair of continuous slide fastener stringers.
Figure 3B:
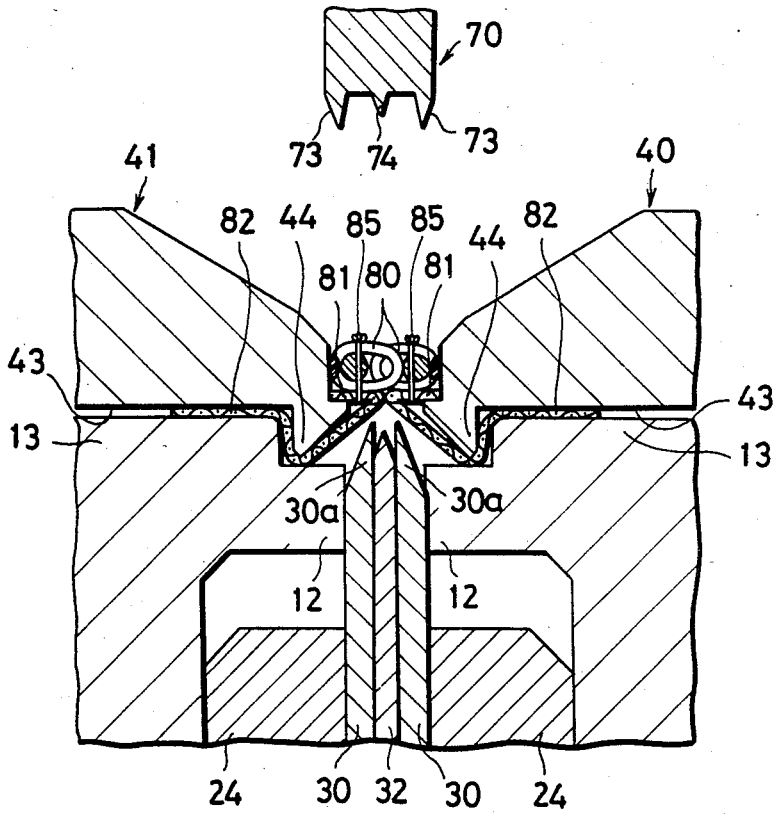
Figure 3C:
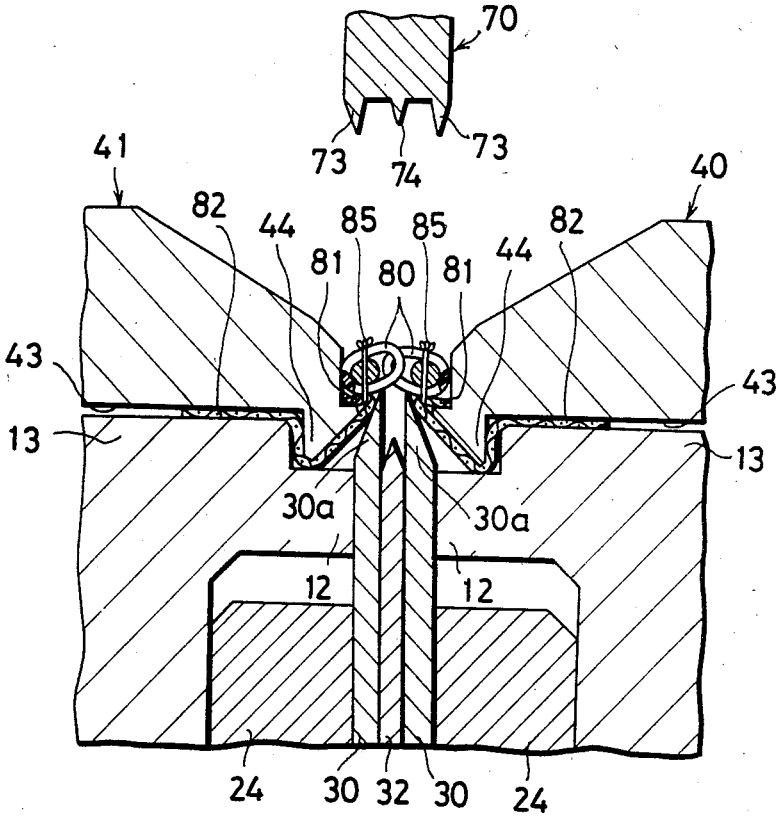

As shown in FIG. 3C, the dies 30, 30 are vertically movable and have a pair of elongated pushing edges 30*a*, 30*a* projectable into a space between the step portions 42, 42 of the guide plates 40, 41 for pushing the fastener stringers upwardly from the under side of the gripped tapes 82, 82 until head portions of a series of the interengaged coupling elements 80 are exposed to the dies 30, 30 and then supported thereon. Preferably, the pushing edge 30*a* of each die 30 has a length slightly greater than the length L of an element-free or space section 83 (FIG. 4) to be formed.

A punch 70 is carried by a punch holder 72 vertically movably mounted on a pair of parallel posts 71 (only one shown in FIG. 1) fixed to the base 2 of the apparatus. The punch holder 72 is adapted to be connected to an upper plunger (not shown) for vertical motion. The punch 70 has a pair of laterally spaced, elongated cutting edges 73, 73 that are movable, in response to vertical movement of the punch 70, toward and away from the step portions 42, 42 of the guide plates 40, 41 to cut a space-section length L of the interengaged rows of the coupling elements 80 only at their upper leg portions (remote from the tapes), as shown in FIG. 3D.

Figure 3D:
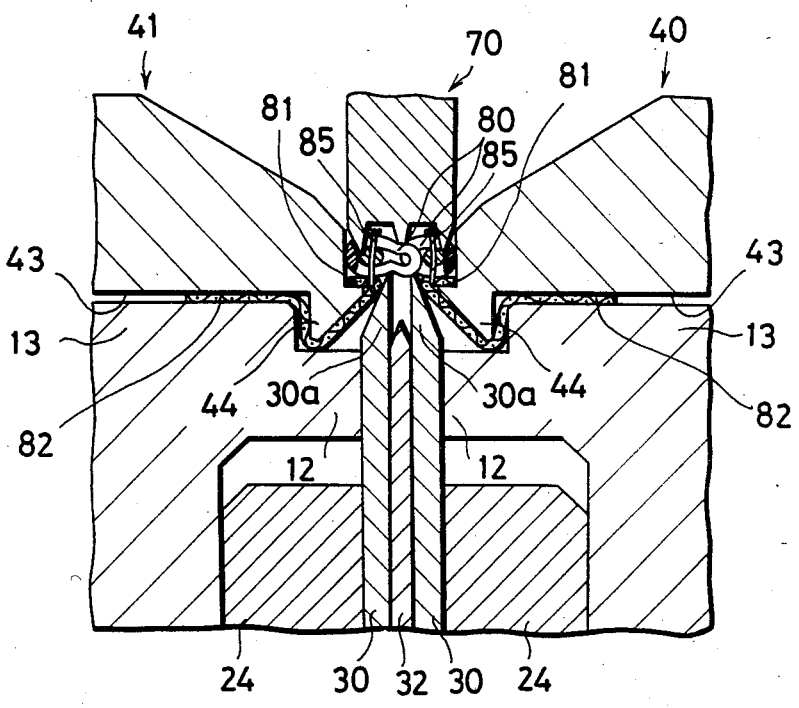
Figure 3E:
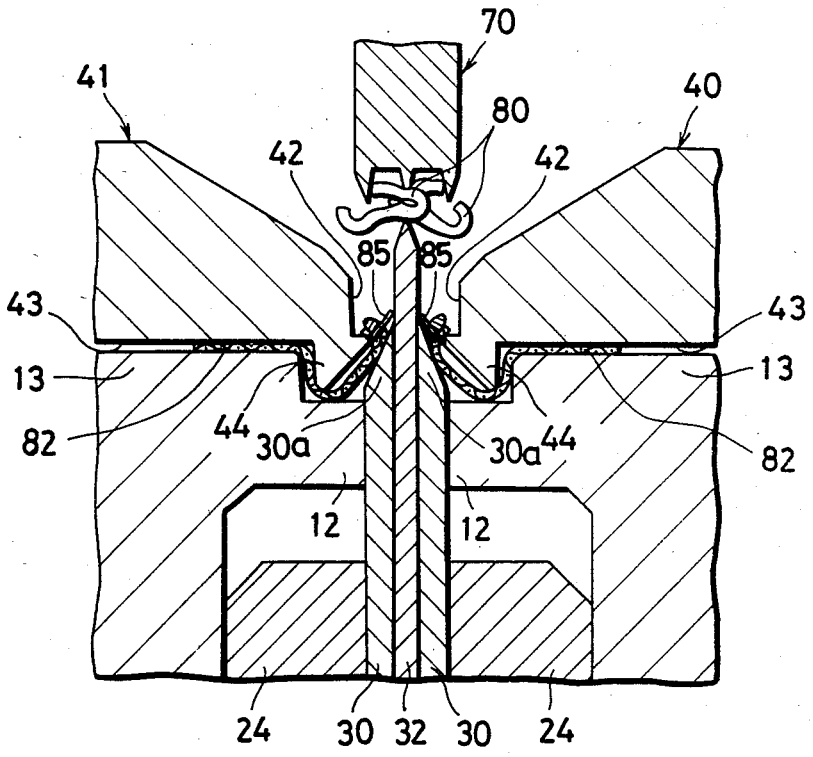

The punch 70 also has an elongated pressing edge 74 disposed centrally between the two cutting edges 73, 73 for pressing the head portion of the cut coupling elements 80 against the dies 30, 30 to crush the head portions, as shown in FIG. 3D.

Figure 2:
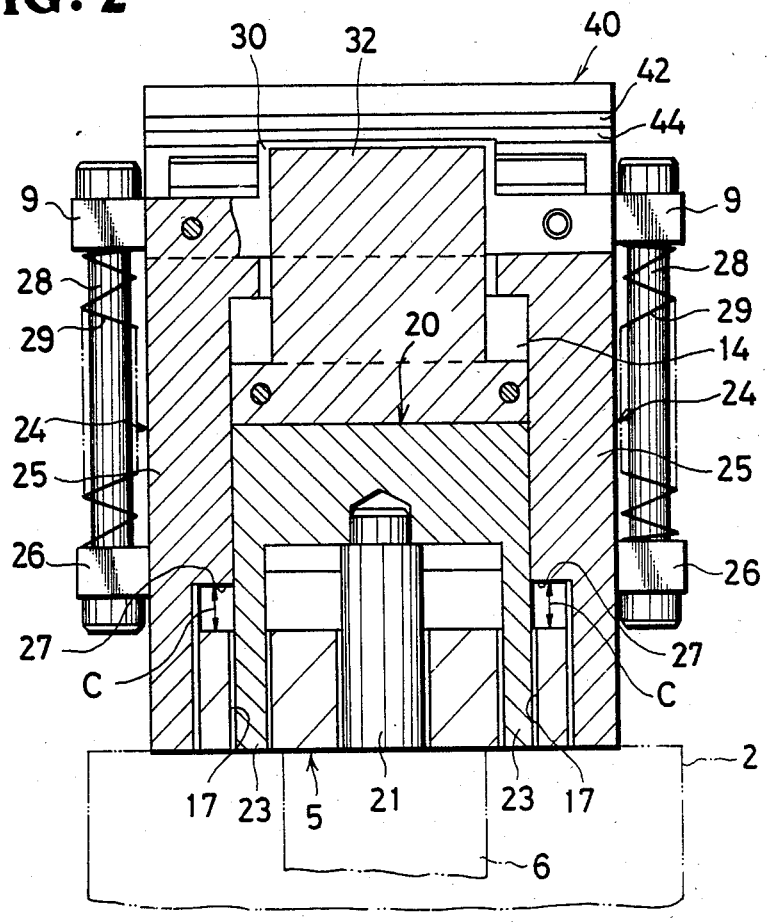
FIG. 2 is a cross-sectional view taken along line II—II of FIG. 1.

As shown in FIGS. 1 and 2, the apparatus also includes an ejector 32 vertically movably disposed between the dies 30, 30 and projectable beyond the pushing edges 30*a*, 30*a* thereof through the space between the step portions 42, 42 of the guide plates 40, 41 for clamping the cut coupling elements 80 against the punch 70. The ejector 32 is upwardly movable together with the punch 70 relative to the step portions 42, 42 of the guide plates 40, 41 and the dies 30, 30 for pulling the cut coupling elements 80 out of the sewn stitches 85, 85 while the tapes 82, 82 are gripped between the pressure pad 12 and the guide plates 40, 41. The ejector 32, the pressure pad 12 and the dies 30, 30 are operatively connected by a drive mechanism so as to be moved in timed relation to one another.

The drive mechanism includes a slide 5 disposed in and an enlarged portion of the bore 10 of the support table 1 and operatively connected to a lower plunger 6 vertically reciprocable in the base 2, and a first and a second set of compression springs 7, 15. The first set of compression springs 7 acts between the support table 1 and the slide 5 to urge the latter downwardly, while the second set of compression springs 15 acts between the pressure pad 12 and the slide 5 to vertically urge one away from the other. In response to upward motion of the lower plunger 6, the slide 5 is upwardly movable against the bias of the first and second sets of compression springs 7, 15 until the slide 5 is blocked by a pair of stop portions 8, 8 of the support table 1.

The drive mechanism further includes a die holder 24 vertically movably disposed in a vertical channel 11 in the pressure pad 12, an ejector holder 20 disposed beneath the die holder 24 and connected to the lower plunger 6 via a cylinder 21 for vertical movements, and a third and a fourth set of compression springs 22, 29 (FIGS. 1 and 2). The third set of compression springs 22 acts between the pressure pad 12 and the ejector holder 20 to vertically urge one away from the other, while the fourth set of compression springs 29 (FIG. 2) acts between the support table 1 and the die holder 24 to urge the latter downwardly. As shown in FIG. 2, each of the compression springs 29 of the fourth set is mounted around a bolt 28 fixed to an upper horizontal projection 9 of the support table 1 and extending through a lower horizontal projection 26 of the die holder 24.

The downward movement of each of the slide 5, the ejector holder 20 and the die holder 24 is restricted by the base 2. As shown in FIGS. 1 and 2, as the ejector holder 20 and the slide 5 are actuated by the lower plunger 6 to be moved upwardly against the bias of the first set of compression springs 7, the pressure pad 12 is raised, because of the second and third sets of compression springs 15, 22, from the lower position of FIGS. 1 and 3A, in which there exists a first gap A (FIG. 1) between the under surfaces of the guide plates 40, 41 and the upper surfaces of the pressure pad 12 and in which there exists a second gap B (FIG. 1) between under surfaces 12*a* (FIG. 3A) of the pressure pad 12 and the top surface of the die holder 24, to the upper position of FIG. 3B in which the pressure pad 12 clamps the tapes 82, 82 against the guide plates 40, 41.

As shown in FIG. 2, the die holder 24 has a pair of step portions 27, 27 engageable with the top surface of the slide 5 and there exists a third gap C between the step portions 27 and the upper surface of the slide 5, the third gap C being at least equal to the sum of the first and second gaps A and B (FIG. 1).

As shown in FIG. 1, the movable guide plate 41 is urged by an extension spring 55 away from the fixed guide plate 40, i.e. leftwardly, the extension spring 55 being connected at one end to the movable guide plate 41 and at the other end to a block 53 fixed to the support table 1. A stop 52 is supported on the block 53 and is movable between an upper position (FIG. 1) and a lower position (not shown). In its upper position, the stop 52 projects above the top surface of the support table 1 to prevent the movable guide plate 41 from being moved away from the fixed guide plate 40. In its lower position, the stop 52 is retracted below the top surface of the support table 1 into a vertical hole 51 in the block 52 to allow the movable guide plate 41 to be moved away from the fixed guide plate 40. The vertical movement of the stop 52 between its upper and lower positions is accomplished by turning a release. The release includes a cam shaft 60 extending through an unnumbered horizontal hole of the block 53, a cam 61 formed on an inner end of the cam shaft 60 integrally therewith and engageable with the stop 52 in a recess 52*a*, and a knob 62 mounted on an outer end of the cam shaft 60 for turning the cam 61. The stop 52 is urged to its upper position by a compression spring 59.

In initial loading operation, as the handle is turned through 180° in FIG. 1, the stop 52 is forced downwardly by the cam 61 to its retracted position against the bias of the compression spring 59. The movable guide plate 41 is moved, under the force of the extension spring 55, from the position of FIG. 1 to its retracted position (not shown) to expose the guide groove widely. A pair of continuous fastener stringers for concealed slide fasteners is placed in the guide groove in such a manner that one coupling element row 80 and the corresponding folded tape edge 81 are supported on the step portion 42 of the fixed guide plate 40, with the tapes 82, 82 lying over the respective lands 13, 13. Then the movable guide plate 41 is returned to its original position (FIG. 1) by hand in such a manner that the other coupling element row 80 and the corresponding folded tape edge 81 are supported on the step portion 42 of the movable guide plate 41. With the movable guide plate 41 held in the original position by hand, as the knob is turned for another 180°, the stop 52 is returned to its upper position to prevent the movable guide plate 41 from being moved back to its retracted position.

In space-section forming operation, as shown in FIG. 3A, as the slide 5 and the ejector holder 20 are actuated by the lower plunger 6 to be moved upwardly against the bias of the first set of compression springs 7, the pressure pad 12 is raised due to the second and third sets of compression springs 15, 22. This upward movement of the pressure pad 12 continues until the pressure pad 12 clamps the tapes 82, 82 against the guide plates 40, 41 (FIG. 3B).

With continued upward movement of the slide 5, it comes into engagement with the step portions 27, 27 (FIG. 2) of the die holder 24 and continues to move upwardly with the die holder 24, raising the dies 30, 30 (against the bias of the fourth set of compression springs 29) to push the fastener stringers from the under side of the tapes 82, 82 until head portions of a series of the interengaged coupling elements 80 are exposed to the dies 30, 30 and are then supported on their elongated pushing edges **30*a*, 30*a***, as shown in FIG. 3C.

As the punch 70 is then lowered toward the step portions 42, 42 of the guide plates 40, 41, the upper leg portions of certain interengaged coupling elements 80 supported on the pushing edges **30*a*, 30*a* are severed by the cutting edges 73, 73 and, at the same time, the head portions of the severed coupling elements 80 are compressed between the pressing edge 74 of the punch 70 and the pushing edges 30*a*, 30*a* of the dies 30, 30** to collapsed (FIG. 3D).

Then, as the ejector holder 20 is further raised by the lower plunger 6 against the bias of the third set of compression springs 22, the ejector 32 is moved upwardly to clamp the cut and collapsed coupling elements 80 between the ejector 32 and the punch 70 and continues moving upwardly together with the punch 70, pulling the cut and collapsed coupling elements 80 away from the tapes 82, 82 gripped between the pressure pad 12 and the guide plates 40, 41. As a result, the cut coupling elements 80 have been removed out of the sewn stitches 85, 85 and thus from the folded tape edges 81, 81. The ejector 32 (lower plunger 6) then ceases its upward movement, while the punch 70 (non-illustrated upper plunger) continues to be raised to the position of FIGS. 1, 3A, 3B, 3C.

Finally, the cut and crushed coupling element pieces 80 remaining on the upper edge of the ejector 32 are cleared in a known manner, for example by means of a blower (not shown). Thus a predetermined length L of element-free space section 83 (FIG. 4) has been formed in a pair of continuous slide fastener stringers with no damage to the tapes 82, 82.

Subsequently, as the lower plunger 6 is lowered, the ejector holder 20 is moved downwardly back to the position of FIGS. 1 and 2 and the pressure pad 12 returns to the position of FIGS. 1 and 3A, releasing the tapes 82, 82 so that the pair of continuous slide fastener stringers can be fed, for a desired slide fastener length, for a subsequent space-section forming. Preferably, the feeding of the pair of continuous slide fastener stringers may be accomplished automatically by means of a suitable feed device (not shown).

With this arrangement, it is absolutely unnecessary to pull the tapes 82, 82 laterally away from each other during the space-section forming operation. Accordingly it is possible to form a space section 83 devoid of coupling elements 80 accurately with no damage to the tapes 82, 82, guaranteeing adequate quality slide fastener stringers of the concealed type.

Since most main parts are moved simply vertically, the apparatus can be automated easily and can be operated at high speed. Further, the ejector 32, the dies 30, 30 and the pressure pad 12 are moved by only a single actuating member (lower plunger 6), making the apparatus simple in construction and hence inexpensive.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A method of forming a space section in a pair of concealed-slide-fastener stringers including a pair of continuous tapes carrying along their folded inner longitudinal edges a pair of rows of interengaged coupling elements, each coupling element row being attached to the respective folded tape edge by sewn stitches, said method comprising:

(a) clamping the tapes with the interengaged coupling elements disposed at the upper side of the tapes;

(b) with the tapes clamped, displacing the fastener stringers upwardly from the under side of the tapes by a pair of laterally spaced and vertically movable dies until head portions of a series of the interengaged coupling elements are exposed to the dies and then supported thereon;

(c) cutting certain interengaged coupling elements on the dies by a vertically movable punch coactive with the dies; and (d) with the tapes clamped, pulling the cut coupling elements out of the sewn stitches by the punch and a vertically movable ejector with the cut coupling elements clamped between the punch and the ejector.

2. A method according to claim 1, said cutting including severing upper leg portions of the coupling elements by a pair of laterally spaced and elongated cutting edges of the punch and pressing the severed coupling elements by the punch against the dies to crush the heads portions of the severed coupling elements.

3. An apparatus for forming a space section in a pair of concealed-slide-fastener stringers including a pair of continuous tapes carrying along their folded inner longitudinal edges a pair of rows of interengaged coupling elements, each coupling element row being attached to the respective folded tape edge by sewn stitches, said apparatus comprising:

(a) a support table having means defining a guide groove receptive of the fastener stringers with the interengaged coupling elements disposed at the upper side of the tapes;

(b) a pair of spaced guide plates mounted on said support table in confronting relation to each other and defining an upper side of said guide groove, said guide plates having along their confronting edges a pair of horizontal step portions, respectively, for supporting from below the interengaged coupling elements together with the folded tape edges;

(c) a pressure pad and a pair of laterally spaced dies disposed in said support table and defining a lower side of said guide groove, said pressure pad being vertically movable to clamp the tapes against said guide plates, said dies being vertically movable and having a pair of elongated pushing edges projectable into a space between said step portions of said guide plates for displacing the fastener stringers upwardly from the under side of the tapes until head portions of a series of the interengaged coupling elements are exposed to said dies and then supported thereon;

(d) a punch vertically movable toward and away from said step portions of said guide plates for cutting certain interengaged coupling elements supported on said dies;

(e) an ejector vertically movably disposed between said dies and projectable beyond said pushing edges thereof through the space between said step portions of said guide plates for clamping the cut coupling elements against said punch for jointly removing the cut coupling elements clamped therebetween; and (f) means for actuating said pressure pad, said dies and said ejector in timed relation to one another.

4. An apparatus according to claim 3, said punch having a pair of laterally spaced, elongated cutting edges for severing upper leg portions of the coupling elements.

5. An apparatus according to claim 4, said punch further having an elongated pressing edge disposed centrally between said cutting edges for pressing the head portions of the severed coupling elements against the dies to crush the head portions.

6. An apparatus according to claim 3, said pressure pad having on its top surface a pair of parallel flat horizontal elongated lands disposed one at each side of said dies, said guide plates having in their under surfaces a pair of flat horizontal elongated recesses complementary to said lands, respectively.

7. An apparatus according to claim 6, each of said guide plates having an elongated jaw interconnecting a respective one of said step portions and a respective one of said recesses.

8. An apparatus according to claim 3, said actuating means including:

(a) a stationary base disposed under said support table;

(b) a plunger vertically reciprocable in said base;

(c) a slide vertically movably disposed in said support table, said slide being upwardly movable in response to upward movement of said plunger;

(d) a first set of compression springs acting between said support table and said slide to urge the latter downwardly toward said base;

(e) a second set of compression springs acting between said pressure pad and said base to urge vertically one away from the other;

(f) an ejector holder supporting said ejector and connected to said plunger, said ejector holder being vertically movable, in response to the vertical movement of said plunger, between a projected position in which said ejector projects beyond said pushing edges of said dies through the space between said guide plates and a retracted position in which said ejector is retracted into said dies;

(g) a third set of compression springs acting between said pressure pad and said ejector holder to urge vertically one away from the other;

(h) a die holder supporting said dies and vertically slidably connected to said slide, said die holder being vertically movable, in response to the vertical movement of said slide, between an upper position in which said ejector projects into the space between said step portions of said guide plates and a lower position in which said ejector is retracted into said dies, while said ejector holder is vertically moved between said projected position and said retracted position; and (i) a fourth set of compression springs acting between said support table and said die holder to urge the latter downwardly toward said base.

9. A method of forming a space section in a pair of concealed-slider-fastener stringers including a pair of continuous tapes carrying along the folded inner longitudinal edges a pair of rows of interengaged coupling elements, each coupling element row being attached to the respective folded tape edge by sewn stitches, said method comprising:

(a) clamping the outer margin of the tapes remotely from the coupling elements with the interengaged coupling elements disposed at the upper side of a double thickness of the tapes;

(b) with the outer margins of the tapes thus clamped, displacing the folded longitudinal inner edges of the fastener stringers upwardly from the underside of the tapes by a pair of laterally spaced and vertically movable dies until the leading edges of the dies have passed between the stringers to expose, to engage and to directly support head portions of a series of the interengaging coupling elements;

(c) cutting certain interengaged coupling elements on the dies by a vertically movable punch coactive with the dies; and (d) with the outer margins of the tapes still clamped, pulling the cut coupling elements out of the sewn stitches by the punch and a vertically movable ejector with the cut coupling elements clamped between the punch and the ejector.

10. A method according to claim 9, said cutting including pressing the severed coupling elements by the punch against the leading edges of the dies to crush the head portions of the severed coupling elements.

* * * * *